US005582156A

United States Patent [19]

Cullum et al.

[11] Patent Number: 5,582,156

[45] **Date of Patent: * Dec. 10, 1996**

[54] TWO-CYCLE INTERNAL COMBUSTION ENGINE WITH REDUCED UNBURNED HYDROCARBONS IN THE EXHAUST GAS AND ADJUSTABLE SPARK GAP ELECTRODES

[75] Inventors: Harry Cullum, East Hampton; Jonathan Korn, New York, both of N.Y.

[73] Assignee: BRQT Corporation, New York, N.Y.

[ * ] Notice: The term of this patent shall not extend beyond the expiration date of Pat. No. 5,388,561.

[21] Appl. No.: 388,011

[22] Filed: Feb. 13, 1995

Related U.S. Application Data

[63] Continuation-in-part of Ser. No. 40,068, Mar. 30, 1993, Pat. No. 5,388,561, which is a continuation-in-part of Ser. No. 7,937, Jan. 25, 1993, Pat. No. 5,311,854.

[51] Int. Cl.[6] ..... F02B 23/00

[52] U.S. Cl. ..... 123/672

[58] Field of Search ..... 123/672, 561, 123/698, 65 BA, 169 EL, 65 B, 65 R, 703, 734, 73 B, 73 C, 73 S, 162, 41.38, 674, 436

[56] References Cited

U.S. PATENT DOCUMENTS

| | | | |
|---|---|---|---|
| 1,452,054 | 4/1923 | Propst | 123/143 R |
| 1,714,463 | 5/1929 | Holroyd | 123/143 R |
| 2,031,293 | 2/1936 | Wamelink | 123/143 R |
| 3,056,363 | 5/1962 | Garcea | 123/561 X |
| 3,349,760 | 10/1967 | Horan | 123/162 |
| 3,640,255 | 2/1972 | Voelz | 123/703 X |
| 3,926,154 | 12/1975 | Williams | 123/703 X |
| 4,399,778 | 9/1983 | Ancheta | 123/65 VB |
| 4,556,030 | 12/1985 | Aono | 123/425 |
| 4,576,126 | 3/1986 | Ancheta | 123/41.38 |
| 4,774,914 | 10/1988 | Ward | 123/162 |
| 4,789,939 | 12/1988 | Hamburg | 123/674 X |
| 4,903,648 | 2/1990 | Lassankse | 123/436 |
| 4,936,277 | 6/1990 | Deutsch et al. | 123/436 |
| 4,960,097 | 10/1990 | Tachibana et al. | 123/444 |
| 4,984,540 | 1/1991 | Morikawa | 123/73 C |
| 4,995,354 | 2/1991 | Morikawa | 123/68 V |
| 5,058,857 | 10/1991 | Hudson | 251/30.05 |
| 5,080,064 | 1/1992 | Buslepp et al. | 123/399 |
| 5,226,921 | 7/1993 | Leistritz | 123/703 |
| 5,299,549 | 4/1994 | Schatz | 123/672 |
| 5,309,050 | 5/1994 | Morinigo et al. | 310/14 |
| 5,334,265 | 8/1994 | Shalin et al. | 148/302 |
| 5,350,153 | 9/1994 | Morinigo et al. | 251/129.16 |
| 5,352,101 | 10/1994 | Morinigo et al. | 417/410.1 |
| 5,354,185 | 10/1994 | Morinigo et al. | 417/410.1 |
| 5,355,108 | 10/1994 | Morinigo et al. | 335/262 |

FOREIGN PATENT DOCUMENTS

| | | | |
|---|---|---|---|
| 499549 | 11/1954 | Italy | 123/672 |
| 055218 | 5/1979 | Japan | 123/672 |

OTHER PUBLICATIONS

*Mark's Standard Handbook for Mechanical Engineers*, Eighth Edition, Published by McGraw Hill Book Company, 1978, pp. 9–78 to 9–115.

Blair, Gordon P., *Reduction of Fuel Consumption and Exhaust Emissions*, published by The Society for Automotive Engineers, Inc., 1990, pp. 299–357.

D. Watry, R. Sawyer, R. Green and B. Cousyn, "The Application of An Air–to–Fuel Ratio Sensor to the Investigation of a Two–Stroke Engine", pp. 1–8, S.A.E. Publication No. 910,720.

Design News, Oct. 7, 1991, "Battle Of The Two–Strokes", Charles J. Murray, pp. 100–102, 104, 106.

*Primary Examiner*—Raymond A. Nelli

*Attorney, Agent, or Firm*—Harness, Dickey & Pierce, P.L.C.

[57] ABSTRACT

A two-cycle internal combustion engine configuration and control strategy in which the unburned hydrocarbon emissions are measured in the exhaust manifold during the scavenging process using a fast response air fuel sensor. The signal from the sensor is used to control the operation of a low pressure ratio blower and the inlet fuel and oil flow. In this way the inlet flow of fuel and air may be reduced which controls the short circuiting loss of fuel during the scavenging process and reduces unburned hydrocarbons in the exhaust gas.

28 Claims, 5 Drawing Sheets

TWO-CYCLE INTERNAL COMBUSTION ENGINE WITH REDUCED UNBURNED HYDROCARBONS IN THE EXHAUST GAS AND ADJUSTABLE SPARK GAP ELECTRODES

CROSS REFERENCE TO RELATED APPLICATIONS

This is a continuation-in-part application of application Ser. No. 08/040,068, filed Mar. 30, 1993, which is a continuation-in-part of application Ser. No. 08/007,937, filed Jan. 25, 1993.

FIELD OF THE INVENTION

This invention is in the field of two-cycle internal combustion engines, particularly including the types used for power boats and power tools.

BACKGROUND

The two-stroke engine, also referred to as the two-cycle engine, has long been the power plant of choice for applications where power to weight ratio and mechanical simplicity are critical parameters for the operator. This is evident by their widespread use as outboard motors, motorcross motorcycle racing engines and as the power plants for small, hand held tools such as chain saws and weed cutters.

Typical in these engines is a simple exhaust gas scavenging system established mainly by ports in the cylinder wall that are covered and uncovered by movement of the piston. Thus, numerous complicated and expensive seals, valves and related components required in four cycle engines are not required and are consequently omitted.

As the CAFE standards for automobile fleets have increased, the industry has placed even more of a premium on the power-to-weight ratio of the engine. A small engine of the same power as a larger one lowers the weight of the vehicle and permits the design of vehicles having smaller frontal area and consequent lowered wind resistance. Both of these design factors have beneficial effects on fuel economy.

While interest in two-stroke engines is very high in the automotive industry, the problem of unburned hydrocarbon emissions remains unsolved. Also, current and pending legislation on exhaust emission for off-highway vehicles, lawn and garden equipment and marine craft has brought the emission problems of the two-stroke engine to the forefront of those industries. Both the recreational and automotive industries are anxious for an economical way to control the emissions, in particular the unburned hydrocarbon emissions, and improve the fuel efficiency of two-stroke engines.

Numerous U.S. Patent discuss the construction, operation, and characteristics of two-cycle engines. Examples of such patents include: U.S. Pat. No. 4,399,788, issued Aug. 23, 1983, to Bostelmann for INTERNAL COMBUSTION ENGINE COMPRISING MEANS FOR CONTROLLING THE AXIAL EXTENT OF AN EXHAUST PORT IN A CYLINDER; U.S. Pat. No. 4,556,030, issued Dec. 3, 1985, to Aono for CONTROL ARRANGEMENT FOR INTERNAL COMBUSTION ENGINE; U.S. Pat. No. 4,576,126, issued Mar. 18, 1986, to Ancheta for TWO-STROKE INTERNAL COMBUSTION ENGINE; U.S. Pat. No. 4,903,648, issued Feb. 27, 1990, to Lassankse for ENGINE WITH IMPROVED EXHAUST GAS SENSING; U.S. Pat. No. 4,936,277, issued Jun. 26, 1990, to Deutsch et al. for SYSTEM FOR MONITORING AND/OR CONTROLLING MULTIPLE CYLINDER ENGINE PERFORMANCE; U.S. Pat. No. 4,960,097, issued Oct. 2, 1990, to Tachibana for AIR-FUEL RATIO CONTROL SYSTEM FOR TWO-CYCLE ENGINE; and U.S. Pat. No. 4,995,354, issued Feb. 26, 1991, to Morikawa for TWO-CYCLE ENGINE.

Although the large power to weight ratio of these engines is a desirable characteristic for automobile power plants, their high unburned hydrocarbon emissions (from short circuited air fuel mixture during the scavenging process) and the attendant fuel economy penalty has precluded their widespread acceptance into these markets. With respect to the high hydrocarbon emissions, it is known, for example, that hydrocarbon emissions of the typical two-cycle engine is many times higher (perhaps even ten times higher) than the level of similar emissions produced by the conventional four-cycle engine.

The massive quantity of unburned hydrocarbons discharged by the exhaust contribute greatly to inefficiency, wasted fuel, and pollution of the atmosphere. To some extent these problems have been ignored by continuing reliance on old technology or by choosing alternative power sources replete with their own inherent disadvantages such as higher cost, higher complexity and lower power-to-weight ratios.

In addressing the above-mentioned problems and operational characteristics in two-cycle engines, engineers and mechanics have experimented with a variety of structural components, seeking improvements and solutions. Typical carburetor and throttle devices vary the air/fuel ratio or the rate or directional path of air/fuel flow, or otherwise modify such variables as ignition, timing, or fuel composition.

A principal focus of researchers attempting to overcome known problems is the high degree of unburned hydrocarbons in the exhaust gas of two-cycle engines due to short circuiting of fuel during the scavenging process. Typically, the carburetor is adjusted to a selected air/fuel ratio, and then the flow of this mixture is throttled by an appropriate valve. In an outboard two-cycle engine the up-stroke of the piston creates a suction which draws in the mixture, the flow of which being throttled by partial blockage of flow into the crankcase.

One alternative control technique used in an engine is produced and is available under the commercial name "Orbital" (trademark; Orbital Engine Company Proprietary Limited, Balcatta, Australia). The operative principal underlying this system is the injection of fuel directly into the cylinder prior to combustion. More particularly, inlet air is pumped into the cylinder to scavenge or clean out exhaust gas. Later, as the piston rises and closes the inlet air port, fuel injection follows. In theory this should substantially eliminate unburned fuel from short circuiting since the scavenging air passing through the cylinder head does not carry the new charge of fuel. On the negative side of this design is the added work input of high pressure fuel injection directly into a closed cylinder head, as compared to the "Roots" blower (trademark; Dresser Industries, Inc., Dallas, Tex.) low pressure air flow (1 to 1½ atmospheres) which carries the fuel into the cylinder via a typical simple and inexpensive carburetor. The air/fuel mixture in the Orbital control is varied by adjusting the high pressure fuel injection within the cylinder after the port is closed. To control such adjustments over a wide range is difficult, costly, and has not been proven satisfactory.

SUMMARY OF THE INVENTION

The present invention refers to a new two-stroke engine system configuration and operation sequence in which a closed loop sensing system monitors selected ones of chemical components in the exhaust manifold during the scavenging process and executes instructions for a fuel and air control sequence to reduce or terminate the intake air flow (and included fuel) if and when the chemical composition of the exhaust dictates. By implementing this closed loop system, the production of large amounts of unburned hydrocarbon emissions produced by short circuiting can be controlled without having to implement more costly in-cylinder fuel injection, and fuel can be optimized.

The new two-stroke internal combustion engine of the present invention has an air blower providing relatively low pressure air flew into the cylinder. The blower may be powered by a variety of sources, but is preferably powered independent of the crankshatft. The engine includes fuel injection whereby the air/fuel mixture is established outside the cylinder. More specifically, the fuel mixture is injected either upstream of the blower and then carried in the air flow in an amount proportionate to the blower's air flow, or the fuel mixture is injected downstream of the blower with the fuel flow directed to be correctly proportional to the blower's air flow. Optionally, injection of the fuel may be sequenced at the intake port for injection at the most advantageous interval of the engine cycle. The preferred blower is typical, simple, inexpensive and reliable Roots-type blower, or may be driven by an electric motor.

As an additional alternative construction of the intake arrangement, the intake port may be divided horizontally (relative the horizontal axis of the cylinder) in a single intake port or by a pair of independent intake ports such that the cylinder can be flushed by ambient, fuel-free air prior to entrance into the chamber of fuel-rich air. This would require a smaller volume of air/fuel mix, and, because of the reduced volume of the air/fuel mix, would lower the occurrence of the short circuiting of fuel.

In this new invention power output is controlled by varying the blower's air flow with an attendant proportional change in fuel flow, and with air/fuel ratio being generally maintained unless intentionally varied separately from the above-described variation in air flow.

A sensor monitors the temperature of the exhaust gas and/or its components and determines the presence of excessive unburned hydrocarbons, while also optionally monitoring other components of the exhaust such as oxygen, carbon monoxide and nitrogen oxides. In response to the sensing of one, some, or all of these exhaust components, and the blower speed, an appropriate signal produced by the sensors and directed through a control system prompts the blower to send more or less air and/or fuel into the cylinder's inlet.

Control and adjustment in this new engine is dynamic in that monitoring of the exhaust gas and the blower speed is essentially continuous and nearly instantaneous using a very high speed sensor. Feedback is to the air blower, and to the injectors (if used). Throttling of the air flow cuts air and fuel at generally the same percent and thus generally maintains a fixed air/fuel ratio, unless and until it is intentionally altered.

In one embodiment of this invention the blower would run essentially continuously with variation in its speed and resultant air flow and associated fuel flow. In an alternate embodiment the blower would be intermittently stopped when the sensor determined excessive unburned hydrocarbons. In either case the sensor's high speed response time would be followed by a relatively fast response in the blower operation.

As a further optional variation, the blower could charge a pressure holding chamber. Such chamber being operable through one or more valves could provide any required air flow in combination with fuel injection as described earlier. Such air flow and attendant fuel flow could supply a single combustion cylinder or, using a manifold, could supply a plurality of combustion cylinders.

The invention described herein is a new technique for monitoring exhaust emissions such as the unburned hydrocarbon emissions from the two-stroke engine and using a feedback control scheme to alter the air and fuel flow into the intake system and thus minimize the unburned hydrocarbon emissions caused by short circuiting and inefficient use of fuel. In the operation of the engine of the present invention the unburned hydrocarbon sensor located in the exhaust is known to exist, and is produced by or for Nissan. If during the scavenging process the air/fuel sensor detects unburned hydrocarbons in the exhaust manifold, the output voltage of the sensor rapidly changes (having a response time of approximately 50 msec.) which then triggers the control circuitry for the blower system and the fuel flow. This rapidly reduces or terminates air flow and reduces or terminates short circuiting of the unburned hydrocarbons into the exhaust and out into the atmosphere. In this way the engine dynamically controls the air and fuel flow into the engine.

This design yields an engine of high delivery ratio and good scavenging efficiency, retains the advantages of the high power to weight ratio of the two-stroke engine, and reduces the unburned hydrocarbon emission of a typical two-stroke engine without having to inject fuel directly into the cylinder. It is anticipated that this control device and strategy will be most effective under conditions of high loading, the conditions under which the unburned hydrocarbons are the worst. As this system reduces unburned hydrocarbon emissions, engine power may be altered for a variety of reasons. However, a principal benefit of the present invention is the removal of a quantity of fuel from the inlet air which fuel was not going to be burned anyway.

In addition to the features described above there is optional installation of the ground electrode into the piston crown instead of being integral to the spark plug. This will attempt to dynamically move, both compress and expand the spark plasma and discharge current to enhance early flame development.

A further variation of the spark plug is to have one electrode of the plug movable and adjustable to vary the gap while the plug remains fully installed and while the engine is running or stopped. Instead of the spark plug having one movable electrode, another embodiment herein shows the plug to have a single (first) electrode, and the cooperating electrode is installed separately until its end establishes the desired spark gap with the end of the first electrode. The second electrode is further movable to vary the spark while this electrode and the spark plug remain installed and while the engine is running or stopped.

It is evident from the prior art that vast efforts have been made and Vast sums spent trying to solve the hydrocarbon emissions problems in two-cycle engine. As these efforts continue they appear to become more sophisticated, more complicated, and more expensive, yet still fail to provide satisfactory results. The present invention represents an approach that is totally different from the past, remarkably simple and inexpensive, and one that has promise to be successful despite its unlikeness in view of similar efforts.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENTS

Figure 1:
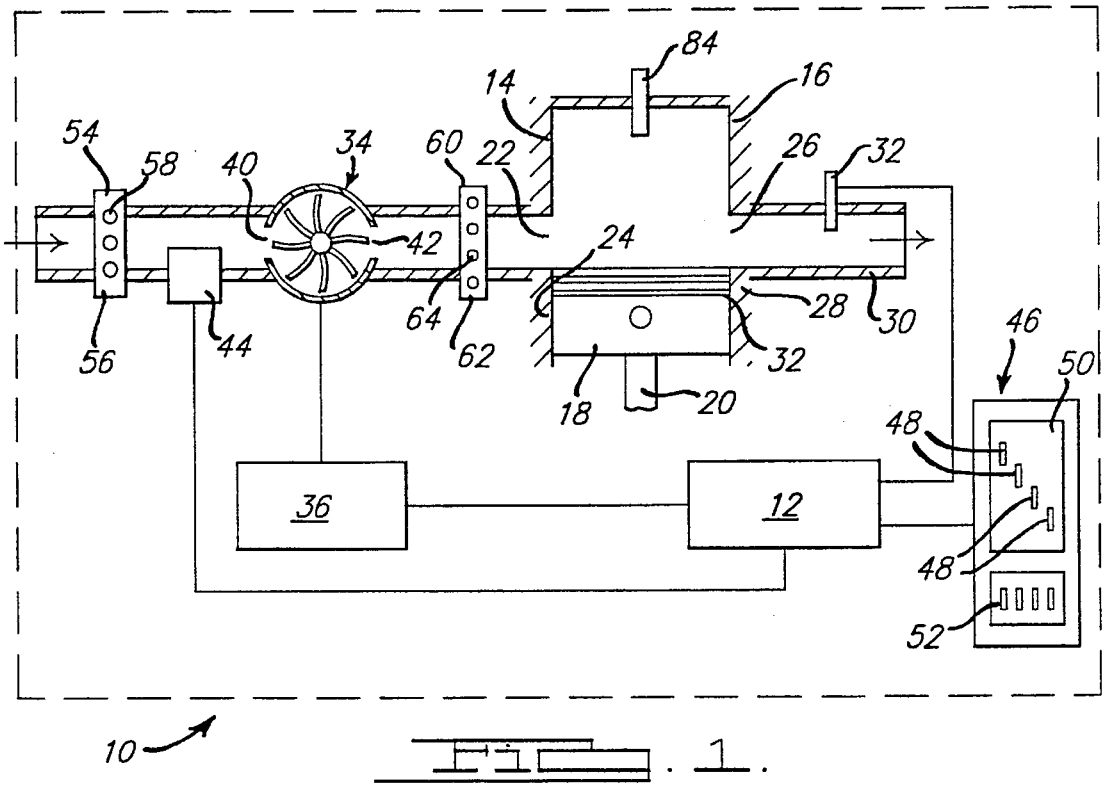
FIG. 1 is a schematic drawing of the new two-cycle internal combustion engine.

The drawing discloses the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

In FIG. 1 a new engine 10 according to the present invention is shown in highly simplified schematic form with a logic control system 12, a cylinder 14, a cylinder head 16, a piston 18, and a piston rod 20. An air/fuel inlet port 22 is fluidly attached to a first side 24 of the cylinder 14 and an exhaust port 26 is fluidly attached to a second side 28 of the cylinder 14. Continuous with the exhaust port 26 is an exhaust pipe 30. Provided on the pipe 30 downstream of the exhaust port 26 is a sensor 32 for monitoring unburned hydrocarbons in the exhaust gas. The sensor 32 may be able to additionally or alternatively monitor other exhaust components including, but not limited to, oxygen, carbon monoxide, and nitrogen oxides. It is understood that the monitoring of selected components of the exhaust gas other than hydrocarbons could be effective in operating the engine 10 as will be described below.

Communicating with inlet port 22 is a Roots-type air blower 34 driven by a motor or pump 36 which may be either electrically or hydraulically driven. Speed is controlled by the engine's operating logic control system 12, which can achieve rapid slowing of the blower as required.

The sensor 32 which preferably (but not necessarily exclusively) determines excessive unburned hydrocarbons in the exhaust may be, for example, the Nissan Air Fuel ratio sensor as described above. This sensor demonstrates a response time of between 25 ms and 100 ms and an accuracy of within three percent in the range of 10–25 A/F using gasoline as the fuel.

The blower 34 has an inlet 40 and an outlet 42. The outlet 34 is adjacent to the inlet 22. Fuel for the engine 10 is introduced via a fuel injector 44 provided either upstream or downstream of blower 34 and into the air stream of the blower. (Where an injector is used [its use being optionally replaced by other known methods of introducing fuel into airstream], a sensor 43 is provided [see FIG. 4] to monitor the temperature of the exhaust gas.) The fuel injector 44 may be simply controlled by the logic control system 12 or may be optionally controlled (through the logic control system 12) by a timing sequence system, generally illustrated as 46, and comprising contacts 48 formed on a timing gear 50 that contact points 52. The timing sequence system 46 provides timed, sequential fuel injection of the blower 34. The sensor 32 still provides the logic control system 12 with information in where the timing sequence system 46 is incorporated. It is to be noted that if injection is downstream near the intake ports, injection would be sequential and adjustable.

As a further variation of the above-described system, it is understood that the introduction of injected fuel upstream of the blower 34 aids in vaporization of the fuel prior to its introduction into the cylinder 14. Vaporization would be further improved the provision of a preheater 54 having a body 56 which supports a series of tubes 58. The tubes 58 are fluidly connected to the exhaust pipe 30. Ambient incoming air circulates around and passes by the tubes 58, thus being warmed by the hot exhaust gases passing through the tubes 58. The fuel entering the incoming air stream from the injector 44, the incoming now warmed by the preheater 54, is more completely vaporized than if the preheater 54 was not provided. To prevent preignition of the warmed air/fuel mix upon introduction into the cylinder 14, an intercooler (to provide for reduced volume of heated air), generally illustrated as 60, is preferably provided. The intercooler 60 includes a body 62 that supports a series of coolant lines 64. Coolant is provided to the lines 64 from a cooling source such as a radiator (not shown) in a conventional manner. With the provision of the intercooler 60, the temperature of the warmed air/fuel mix is reduced to a desired range for introduction into the cylinder 14.

In contrast to prior art engines which effect the alteration of such variables as the fuel volume, the air/fuel ratio, the rate flow of fuel or the air/fuel mix as well as other parameters, the engine 10 of the present invention primarily varies air flow with the fuel secondarily adjusted and driven into the cylinder 14, with the variation dynamically controlled by the logic control sensor 12 as a reaction to the exhaust gas sensor 32, with potential varying of fuel injection as well.

Figure 2:
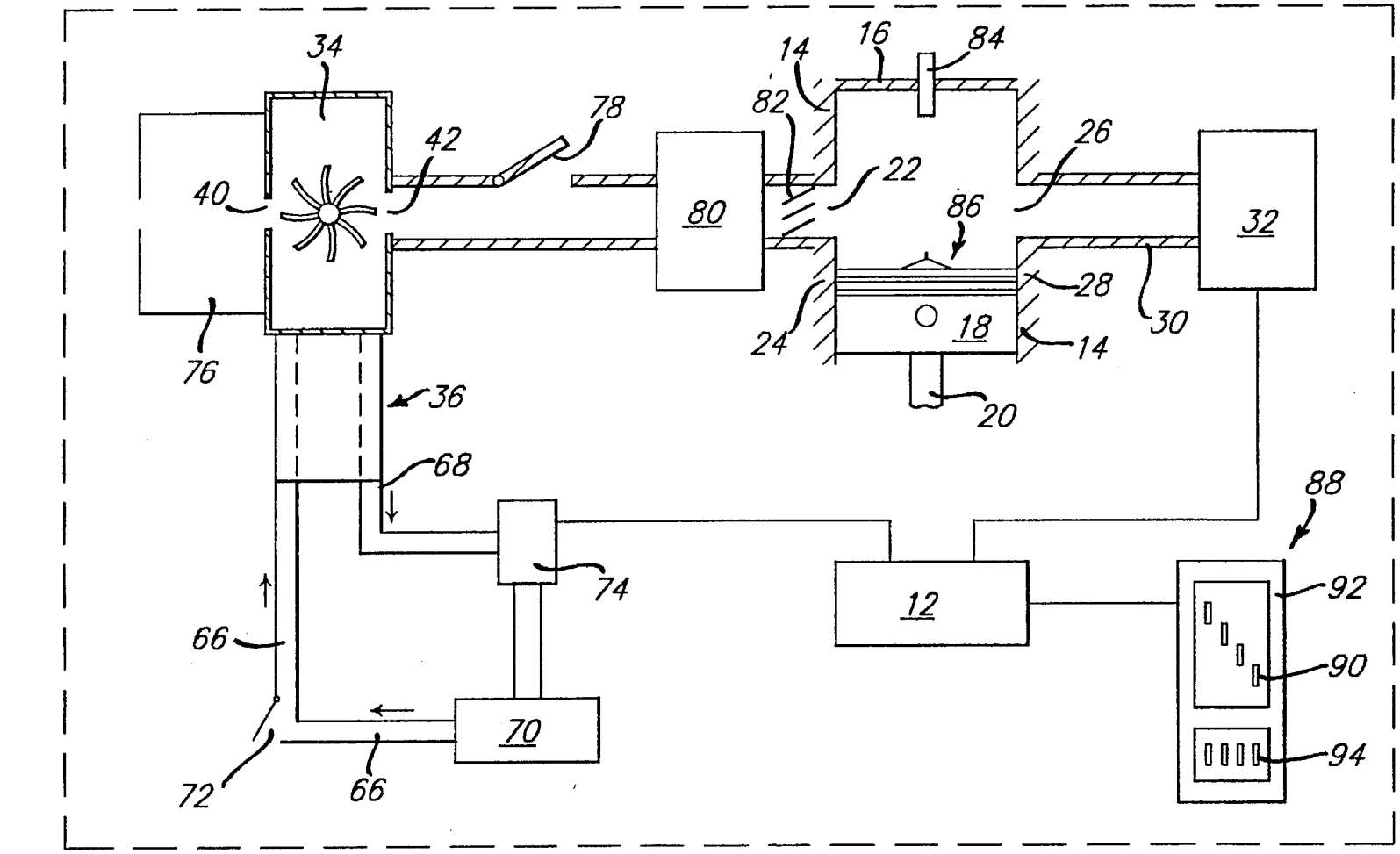
FIG. 2 is a schematic drawing of a variation of the engine of FIG. 1.

FIG. 2 shows the new engine 10 in simplified schematic form that is generally similar to FIG. 1 but having some additions and variations. This engine 10 also includes the logic control system 12, the cylinder 14, the cylinder head 16, the piston 18, the piston rod 20, the inlet port 22 and the exhaust port 26 as described above. Provided on the exhaust pipe 30 downstream of the exhaust port 26 is a sensor 32 for monitoring unburned hydrocarbons in the exhaust gas.

In accordance with the embodiment of FIG. 2, communicating wit h inlet port 22 is the air blower 34 driven by the motor 36. Speed is controlled by a motor speed controller 70 and an associated dump valve 72 of larger diameter than the inlet fluid flow duct 66 and situated so that fluid tends to flow in a straight line when dumped. In the event that the air blower 34 is hydraulically driven, there is a spring loaded valve 74 associated with the oil outflow line set to achieve a quick stop when a drop in oil pressure is monitored. This will aid in the rapid slowing of the blower 34 when directly connected to the motor 36, which would be hydraulic.

The sensor 32 which determines excessive unburned hydrocarbons in the exhaust may be, for example, the Nissan Air Fuel ratio sensor as described above. Also like above, other sensors may be used to detect other components of the exhaust gas.

The air, blower 34 includes the inlet 40 and the outlet 42 as shown, the outlet 42 being directed to cylinder head inlet 22. Fuel for the engine is injected into an air box 76 xx positioned upstream of blower 34. As an alternate addition there may be an air dump valve 78 provided for quick relief or termination of inlet flow. Any fuel present in the air flow is redirected in an appropriately safe manner.

Figure 3:
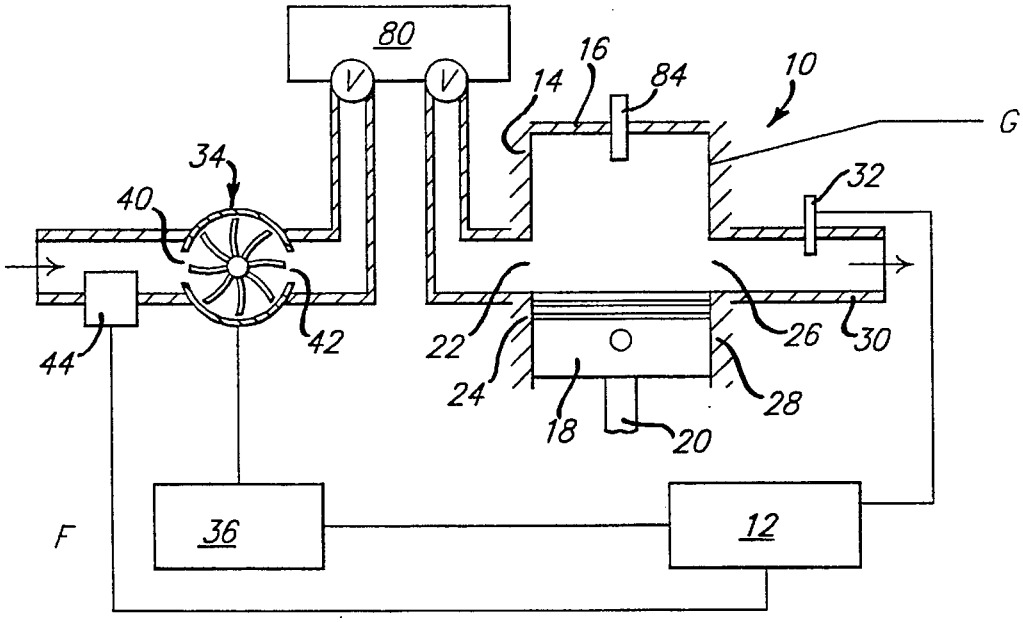
FIG. 3 is a schematic drawing similar to FIG. 1 with the addition of a pressure holding tank.

The schematic drawing of FIG. 3 shows a system essentially the Same as FIG. 1 and having substantially the same reference numbers, but with the addition of a pressure holding tank 80 for receiving and holding the entire output of the blower and fuel injector. From the tank 80 the air fuel mixture is discharged as required into one or more cylinders of the engine, with appropriate timing and metering apparatus to deliver the air/fuel properly.

In an additional variation of the engines of FIGS. 1, 2, or 3, the fuel injection operation of the embodiment shown in FIG. 3 may alternatively be separated entirely from the inlet air and is discharged directly into the cylinder 14. The amount of fuel is controlled so as to be proportionate to the inlet air flow, which can be determined by direct measurement of airflow or from sensing the speed of the blower 34 or by other means. For this latter variation, the fuel line F in FIG. 3 would be replaced by a direct fuel line G.

In contrast to prior art engines which vary the amount of fuel, the air/Fuel ratio, the speed of the flow of fuel or the air/fuel mix and other parameters, this engine of FIG. 3 primarily varies air flow driven into the cylinder 14, with the variation dynamically controlled as a reaction to the exhaust gas sensor 32. To enhance engine efficiency, the air flow from the blower 34 passes by a series of angled deflectors 82 which flushes the mixture in the proper direction into the cylinder 14 and functions as a flame arrestor.

As a further refinement of the engine of the present invention, a combined plug-coil 84 may be provided to fire onto an electrode insert 86 provided in the piston head seeking to provide a longer, hotter spark. This construction would provide for a more complete burn of the air/fuel mix. The upper surface of the piston 18 may also be formed to improve dispersion of the air/fuel mixture prior to ignition.

The electric charge to the plug-coil 84 is controlled by a firing timer, generally illustrated as 88, the timer 88 being similar to the timing sequence system 46 described above with respect to FIG. 1. The firing timer system 88 includes a set of contacts 90 provided on a timing gear 92 that selectively make contact with points 94. The points 94 vary position around the circumference of the timing gear 92 in a manner similar to that of a conventional distributor. To allow for rapid changes of speed such as would ordinarily be used when passing another vehicle, a hook-up throttle to valve assembly would be provided (not shown), similar to the "passing gear" arrangement currently utilized.

Figure 4:
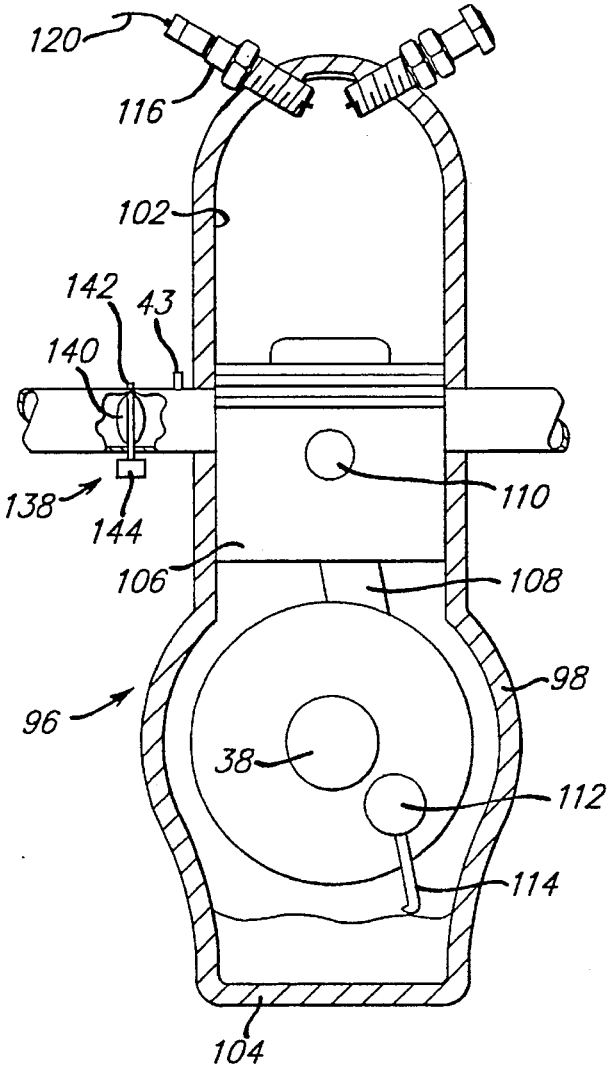
FIG. 4 is a fragmentary sectional view showing an engine with a new spark plug with separated electrodes and illustrating an electronically-operated valve associated with the exhaust port.

Another spark plug variation is shown in FIG. 4 where a two-cycle engine, generally illustrated as 96, is shown. The engine 96 includes a crankcase 98 and a cylinder head 100. A cylinder chamber 102 is formed between the upper part of the crankcase 98 and the cylinder head 100. At the lower end of the crankcase 98 is optionally provided an oil sump 104. The sump 104 may be integral with the crankcase 98 or may be removable in the form of an oil pan (not shown).

A piston 106 is reciprocatingly provided within the cylinder chamber 102. A first end (not seen) of a connecting rod 108 is pivotably attached to the piston 106 by a first wrist pin 110. A second end (also not seen) of the connecting rod 108 is pivotably attached to the crankshaft 38 by second wrist pin 112. As is known, the crankshaft 38 is rotatably supported in the crankcase 98 by an array of bearings (not shown). An oil dipper 114 is fixedly attached to the lowest end (not seen) of the connecting rod 18 for delivering the oil contained in the sump 104 to the critical rotating parts of the crankshaft 38 and its associated bearings.

Centrally positioned within the cylinder head 100 is a principal spark plug 116 having a single electrode 118 and a single power cable 120 coupled to the electrode 118. The cooperating electrode or ground is a separate plug 122 having a movable central electrode 124 and an adjustment assembly 126 for adjusting the position of the electrode 124 inwardly or outwardly with respect to the cylinder head 100 as desired to vary the spark gap between the electrodes 118 and 124. The adjustment assembly 126 may be as simple as a pair of nuts 128 and 130 cooperating with an outer threaded surface 132 formed on a stem 134.

After axial positioning, the nuts 228 and 130 are locked against each other The plug 122, its electrode 124 and the adjusting assembly 126 have an appropriate high pressure seal (not shown) to, allow for this axial movement of the electrode when the engine is either running or stopped. The locations and orientation of the plug 116 and the plug 122 may be varied for optimal performance. A recess 136 may be provided in the ceiling of the cylinder head to allow more space for the spark and combustion. The size, location and orientation of the recess 136 may vary depending on the size and location of the spark plug electrodes, the elevation of the piston at top-dead-center, and other factors.

Still with respect to FIG. 4 and as noted above, an electronic valve assembly, generally illustrated as 138, may be provided on the exhaust pipe 30. The valve assembly 138 includes a valve 140 (which is preferably of the illustrated butterfly type or may be of any known type) that is fixed to a pivoting shaft 142. The ends of the shaft 142 are positioned within aligned apertures formed in the exhaust pipe 30. Rotation of the valve 140 between in a closed position and an open position is controlled by a solenoid assembly 144 operatively attached to the shaft 142. The solenoid assembly 144 is controlled by the logic control system The provision of the valve assembly 138 allows for the selective prohibition of exhaust gas from passing out of the chamber 102. Specifically, the valve 140 is moved to its closed position while fuel is entering the chamber 102, and is moved to its open position after ignition to allow exhaust gas to escape. By blocking the flow of gas out of the chamber 102 while the air/fuel mix is entering the chamber 102, the likelihood of unburned hydrocarbons escaping with the exhaust gas is significantly reduced.

Figure 5:
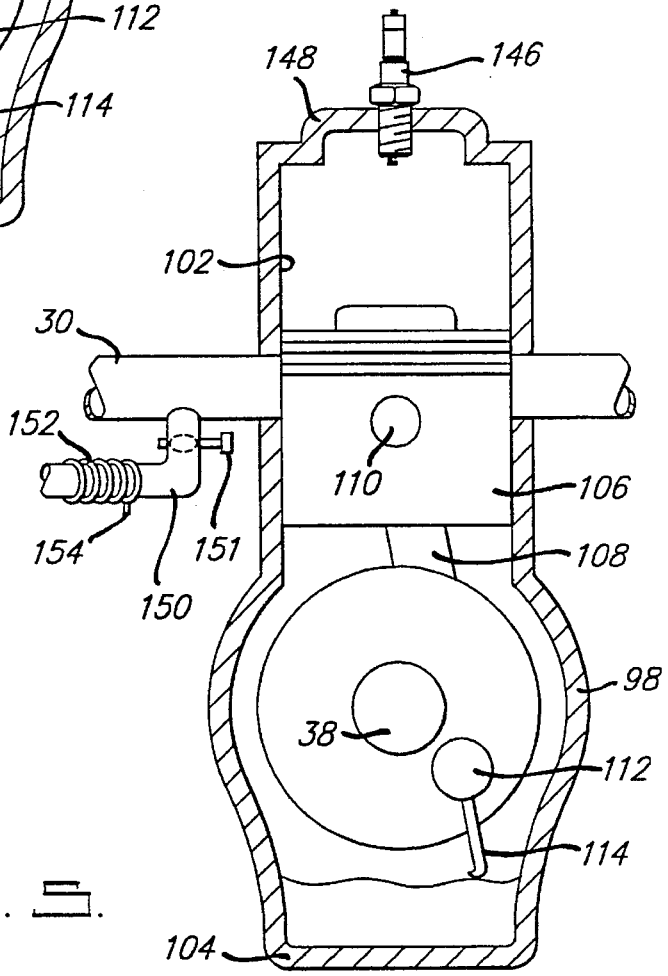
FIG. 5 is a fragmentary sectional view also showing an engine similar to that of FIG. 4 but having an alternate spark plug with a movable electrode and showing the alternate construction associating the exhaust sensor with a coolant media.

FIG. 5 shows a variation of the adjustable spark plug of FIG. 4 in a two-cycle engine. According to this embodiment, a spark plug 146 is centrally provided in a modified cylinder head 148. The spark plug 146 has either its central electrode or its outer ground electrode movable in response to the logic control of the vehicle to vary the spark gap, depending upon engine requirements FIG. 5 also illustrates a method of improving the reliability and consistency of the signals received from the logic system-controlling sensor. According to this embodiment, an auxiliary exhaust pipe 150 is fluidly attached to the exhaust pipe 30. The flew of exhaust gas through the auxiliary exhaust pipe 150 is regulated to a constant pressure by an exhaust gas regulating valve 151 fitted to the pipe 150. This construction allows for a constant flow of exhaust gas whether or not the valve assembly 138 is fitted with the engine 96. Associated with the auxiliary exhaust pipe 150 is a coolant coil 152 that is fluidly connected to a cooling fluid source (not shown) such as a radiator. Passing through the coolant coil 152 is a conventional coolant media. An exhaust sensor 154 is operatively associated with the coil 152. By providing the sensor 154 in association with a coolant media, the sensed exhaust temperature is maintained at a substantially constant level and at a substantially constant pressure, thus eliminating temperature variations due to changes in exhaust gas temperature thereby improving the accuracy of sensing of the output.

Figure 6:
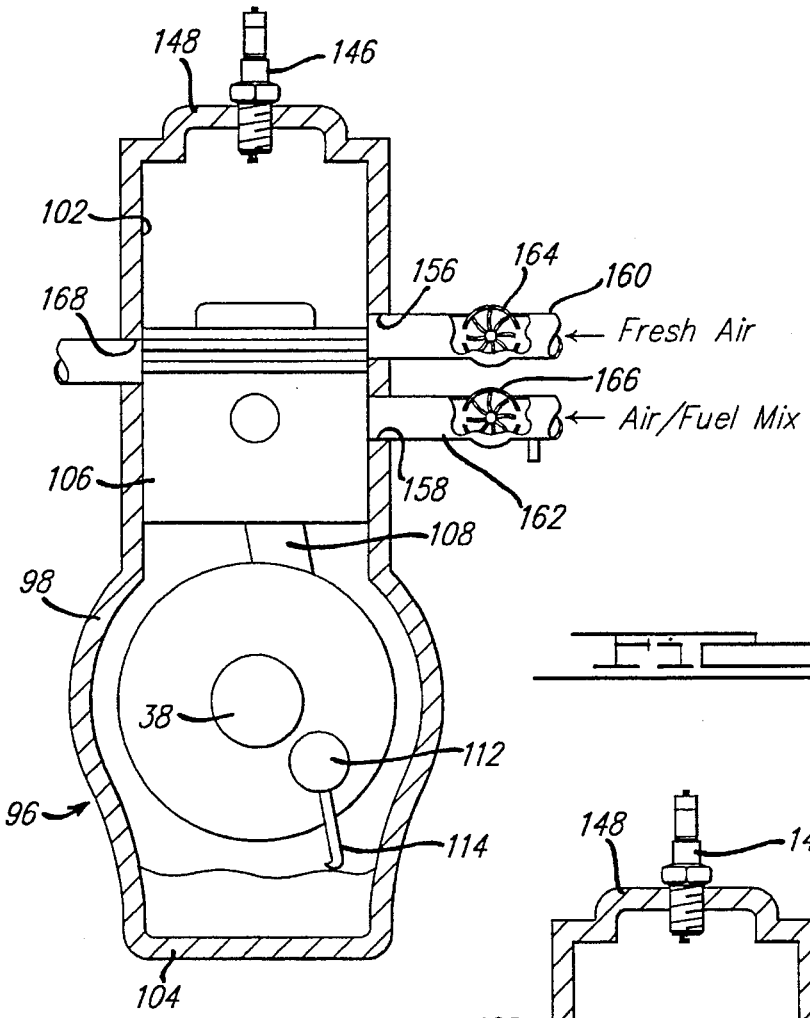
FIG. 6 is a fragmentary sectional view showing an engine similar to that of FIG. 5 but having individual intake ports.

A further improvement of the engine 96 is illustrated in FIGS. 6 add 7 and relates to the separate intake of air and the air/fuel mix. By providing separate ports for each at strategic locations, fresh air may be forced into the chamber 102 to flush the exhaust gas out prior to the introduction of the air/fuel mix. This arrangement minimizes waste of the air/fuel mix and further minimizes the problem of short circuiting.

With reference to FIG. 6, an upper fresh intake port 156 and a lower air/fuel mix intake port 158 are formed in the crankcase wall to the upper intake port 156 is fitted an upper intake pipe 160. To the lower intake port 158 is fitted a lower intake pipe 162. A low pressure blower 164 is fitted to the upper intake pipe 160 for drawing ambient fresh air into the intake pipe 160 and then forcing the air at a relatively low pressure into the chamber 102 through the upper intake port 156. Similarly, a high pressure blower 166 is fitted to the lower intake pipe 158 for forcing the air at a relatively high pressure into the intake pipe 162 and then forcing the air into the chamber 102 through the lower intake port 158.

According to this arrangement, as the piston 106 moves in its cycle from top-dead-center, the upper edge of the piston first bypasses an exhaust port 168 formed in the cylinder wall of the engine opening the chamber 102 to the atmosphere. Further downward movement (this position being relative to the arrangement illustrated in FIGS. 4 through 7) of the piston 106 causes the upper edge of the piston 106 to bypass the upper intake port 156, at which time fresh air is forced into the chamber 102, circulates within the chamber 102, and exhausts the chamber 102 through the exhaust port 168, carrying with it any exhaust gases left within the chamber from the prior ignition. Finally, as the piston 106 moves toward bottom-dead-center, the upper edge of the piston 106 bypasses the lower intake port 158, allowing the air/fuel mix to flow into the chamber 102 for subsequent further scavenging.

Figure 7:
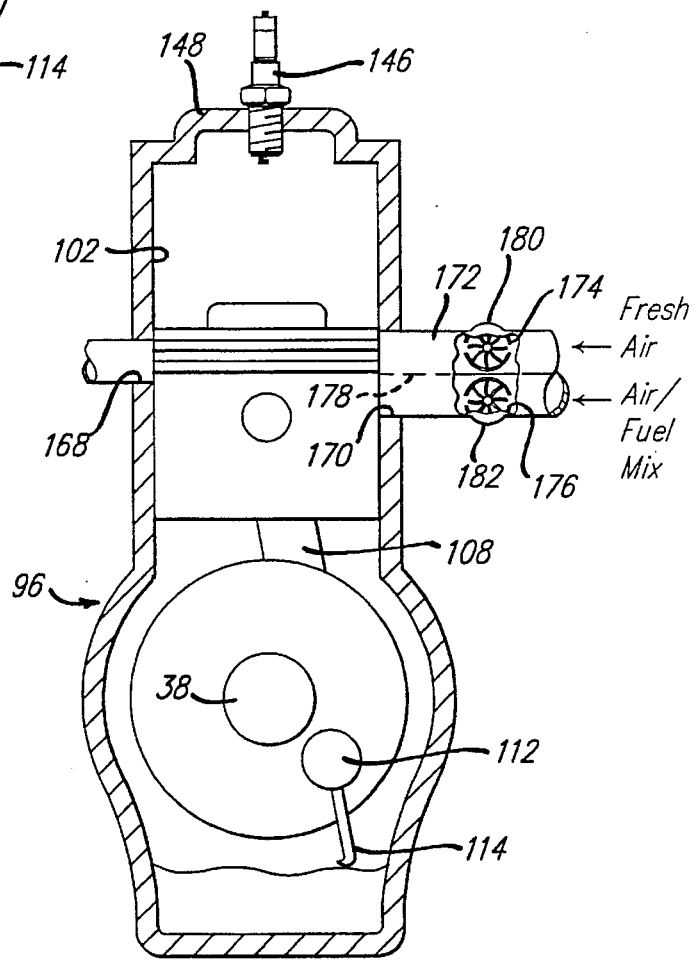
FIG. 7 is a fragmentary sectional view showing an engine similar to that of FIG. 6 but having a single intake port body that is divided horizontally into an upper port and a lower port.

FIG. 7 illustrates a variation of the system set forth in FIG. 6. According to this illustration, a unified air-air/fuel mix port 170 is formed within the wall of the engine 96. A unified air-air/fuel mix intake pipe 172 is fitted to the port 170. Within the air-air/fuel mix intake pipe 172 is provided an upper air plenum 174 and a lower air/fuel mix plenum 176. The plenum 74 is separated from the plenum 176 by a plate 178. Provided within the upper air plenum 174 is an upper blower 180 for forcing fresh air through the pipe 172 and into the chamber 102 through the port 170 at the appropriate time of the engine cycle. Similarly, provided within the lower air/fuel mix plenum 176 is provided a blower 182 for forcing the air/fuel mix through the pipe 172 and into the chamber 102 through the port 170, also at the appropriate time of the engine cycle. The introduction of fresh air into the chamber 102, the flushing of the exhaust gases, and the introduction of the air/fuel mix into the chamber 102 is undertaken in a manner identical to that discussed aboveiwith respect to the embodiment of FIG. 6.

Figure 8:
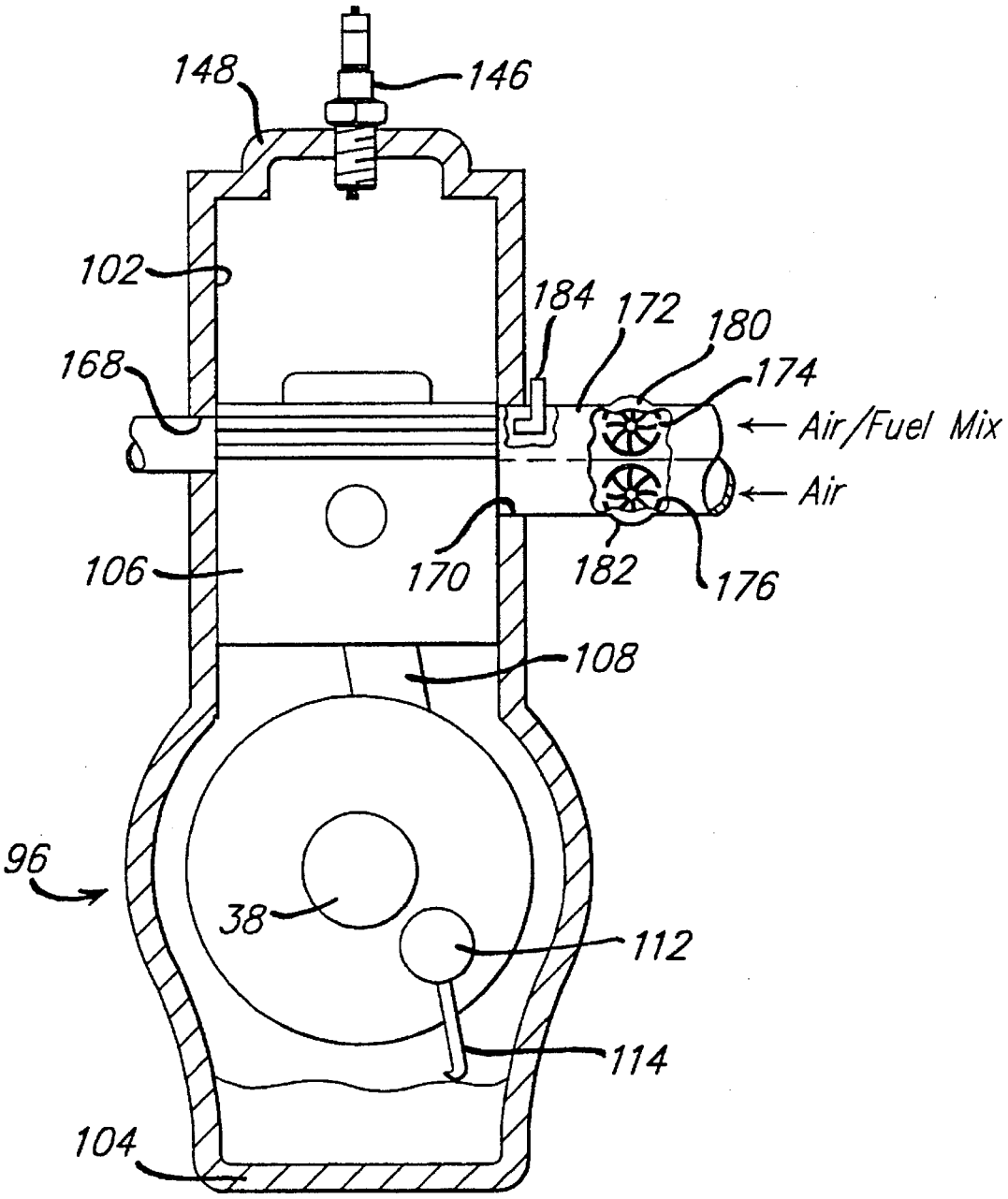
FIG. 8 is a fragmentary sectional view showing an engine similar to that of FIG. 7 but having an injector positioned within the upper inlet portion adjacent to the combustion chamber.

FIG. 8 is a view quite similar to that of FIG. 7, but including a fuel injector 184 positioned within the plenum 174 and adjacent the inlet port 170. According to this arrangement, fuel is not injected through the lower plenum 176, but only through the upper plenum 172. After the cylinder 102 is initially scavenged with the low pressure, fuel-free air of the upper plenum 174, the lower plenum 176 introduces a volume of high pressure, fuel-free air into the cylinder 102, thus virtually completing the scavenging process. The injector 184 is optionally provide to inject an amount of fuel into the chamber 102 after the piston 106 passes bottom-dead-center and is returning toward its top-dead-center. The fuel is injected by the injector 184 at the last minute within the low air pressure. By providing a method by which fuel is injected into the cylinder at the last possible moment, the optional positioning of the injector 184 acts both to allow for more complete scavenging of the exhaust gas and to reduce the amount of raw fuel exiting the chamber 102 prior to combustion.

While the preferred embodiments herein of the present invention have been shown and described, it is to be understood that the disclosure is for the purpose of illustration and that various changes and modifications may be made without departing from the scope of the invention as set forth in the appended claims.

We claim:

1. In a two-cycle internal combustion engine operable with a source of fuel and a source of air, the engine including a cylinder with inlet and outlet ports, a piston slidable in the cylinder for opening and closing said ports, and fuel injection means, the improvement comprising:

sensor means for detecting and evaluating a predetermined chemical component in the exhaust gas and providing signal information thereto;

a blower with an outlet for directing an airflow into the cylinder's inlet port, said fuel injection means having an outlet upstream of and directed into said blower;

drive means driven by said engine and coupled to said blower for varying the outlet air flow of the blower; and control means for receiving said signal information from said sensor means as to said predetermined chemical component in the exhaust gas and for controlling the blower airflow into the cylinder to reduce the output of one of said predetermined chemical component and another chemical component.

2. An engine according to claim 1, further including an exhaust pipe mated with the outlet port.

3. An engine according to claim 2, further including a cooling assembly operatively attached to said exhaust pipe, said sensor means being adapted for attachment to said cooling assembly.

4. An engine according to claim 3, further including an exhaust valve operatively associated with said exhaust pipe, said exhaust valve being selectively movable between an open position whereby exhaust gas is allowed to pass thereby and a closed position whereby the passing of exhaust gas thereby is prevented.

5. An engine according to claim 4, further including a solenoid driver operatively attached to said exhaust valve.

6. An engine according to claim 1, further including an intake pipe attached to the inlet port.

7. An engine according to claim 6, wherein said blower is fitted to said intake pipe, said engine further including a preheater for warming air entering said intake pipe, said preheater being adapted for attachment to said intake pipe.

8. An engine according to claim 7, further including means for cooling an air/fuel mixture operatively attached to said intake pipe between said blower and the inlet port.

9. An engine according to claim 6, said intake pipe comprising an upper air portion and a lower air/fuel mix portion, said upper portion being open to ambient air, said lower portion fluidly connecting the injection means and the inlet port.

10. An engine according to claim 9, wherein said intake pipe comprises an upper pipe defining said upper air portion and a lower pipe defining said lower air/fuel mix portion, said pipes being spaced apart from one another.

11. An engine according to claim 1, further including means for sequentially timing the injection of fuel into said engine.

12. An engine according to claim 11, wherein said predetermined chemical component being sensed by said sensor in said exhaust gas are unburned hydrocarbons.

13. An engine according to claim 11, wherein said control means, upon receiving signal information from said sensor means as to the presence of said predetermined chemical component in the exhaust gas, causes said blower to reduce the airflow and a proportionate amount of fuel into the cylinder.

14. An engine according to claim 11, wherein said sensor has a response time at least as fast as 100 msec. for detecting and evaluating unburned hydrocarbons.

15. An engine according to claim 11, further comprising a hydraulic pump driven by the engine and coupled to drive said blower.

16. An engine according to claim 11, wherein said control means comprises means for continuously receiving signal information data from said sensor means and continuously sending control signals to said drive means, thus providing dynamic feedback for continuously minimizing said one of said predetermined chemical component and another chemical component in the exhaust gas under changing operating conditions of said engine.

17. An engine according to claim 11, operable with a spark plug situated in the cylinder head and the piston has a top, the engine further comprising a ground electrode situated in the top of said piston, said ground electrode being positioned relative to the spark plug so as to beneficially affect spark plasma and discharge current and enhance early flame development.

18. In a two-cycle internal combustion engine operable with a source of fuel and a source of air, the engine including a cylinder with inlet and outlet ports, a piston slidable in the cylinder for opening and closing said ports, and fuel injection means, the improvement comprising:

a sensor means for detecting a predetermined chemical component in the exhaust gas and providing signal information thereto;

a blower with an outlet for directing an airflow into the cylinder's inlet port;

drive means driven by said engine and coupled to said blower for varying the outlet air flow of the blower; and control means for receiving said signal information from said sensor means as to said predetermined chemical component in the exhaust gas and for controlling the blower airflow and fuel injection into the cylinder to reduce one of said predetermined chemical component and another chemical component, with the air/fuel ratio generally maintained when the air flow is reduced.

19. An engine according to claim 18, wherein said control means adjusts air flow from the blower and fuel flow therewith to optimize power output of the engine relative to the load condition.

20. A method of reducing unburned hydrocarbons in the exhaust gas of a two-cycle engine which uses an air blower and fuel injection operable with air flow of the air blower, comprising:

detecting and evaluating a predetermined chemical component in the exhaust gas and providing corresponding signal information;

determining the amount of reduction of air flow and included fuel into the engine's cylinder to reduce the output of one of said predetermined chemical component and another chemical component in the exhaust gas; and providing control means for varying said air flow and included fuel into the engine's cylinder according to said determination of the amount of reduction of air flow and included fuel.

21. A method according to claim 20 wherein the engine is subject to both high and low loading conditions, and wherein the control means reduces said one of said predetermined chemical component and another chemical component during high loading conditions without appreciably reducing engine power.

22. A method according to claim 20, wherein the air/fuel ratio is generally maintained while the air/flow is reduced.

23. A method according to claim 22, wherein the engine is subject to both high and low loading conditions, and wherein the control means reduces the output of said one of said predetermined chemical component and said another chemical component during high loading conditions without appreciably reducing engine power.

24. A method according to claim 23, wherein said one of said predetermined chemical component and another chemical component in said exhaust gas is an unburned hydrocarbon.

25. A method according to claim 20, wherein said predetermined chemical component in said exhaust gas being detected and evaluated is oxygen.

26. A method according to claim 20, wherein said predetermined chemical component in said exhaust gas being detected and evaluated is carbon monoxide.

27. A method according to claim 20, wherein said predetermined chemical component in said exhaust gas being detected and evaluated is nitrogen oxide.

28. In an internal combustion engine operable with a fuel injection means and a source of air, the improvement comprising:

a sensor means for detecting and evaluating a predetermined chemical component in the exhaust gas and providing signal information thereto;

a blower with an outlet for directing an airflow into the cylinder's inlet port;

drive means driven by said engine and coupled to said blower for varying the outlet air flow of the blower; and control means for receiving said signal information from said sensor means as to said chemical component in the exhaust gas and for controlling the blower air flow and fuel injection into the cylinder to reduce selected ones of said predetermined chemical component and other chemical components, with the air/fuel ratio generally maintained when the air flow is reduced.

* * * * *